US009018557B2

(12) United States Patent
Kostovic

(10) Patent No.: US 9,018,557 B2
(45) Date of Patent: Apr. 28, 2015

(54) GAS-INSULATED CIRCUIT BREAKER WITH NOMINAL CONTACT SHIELDING ARRANGEMENT

(71) Applicant: Jadran Kostovic, Wettingen (CH)

(72) Inventor: Jadran Kostovic, Wettingen (CH)

(73) Assignee: ABB Technology AG (CH)

( * ) Notice: Subject to any disclaimer, the term of this patent is extended or adjusted under 35 U.S.C. 154(b) by 0 days.

(21) Appl. No.: 14/460,928

(22) Filed: Aug. 15, 2014

(65) Prior Publication Data

US 2014/0353279 A1 Dec. 4, 2014

Related U.S. Application Data

(63) Continuation of application No. PCT/EP2013/052958, filed on Feb. 14, 2013.

(30) Foreign Application Priority Data

Feb. 17, 2012 (EP) ..... 12155974

(51) Int. Cl.

| | |
|---|---|
| ***H01H 33/12*** | (2006.01) |
| ***H01H 9/32*** | (2006.01) |
| ***H01H 33/00*** | (2006.01) |
| ***H01H 33/70*** | (2006.01) |
| ***H01H 33/42*** | (2006.01) |

(52) U.S. Cl.

CPC ..... *H01H 33/122* (2013.01); *H01H 9/32* (2013.01); *H01H 33/002* (2013.01); *H01H 33/7023* (2013.01); *H01H 33/42* (2013.01)

(58) Field of Classification Search

USPC ..... 218/51–52, 66, 126

See application file for complete search history.

(56) References Cited

U.S. PATENT DOCUMENTS 3,909,572 A * 9/1975 Tsubaki et al. ..... 218/62
3,946,183 A * 3/1976 Milianowicz ..... 218/66

(Continued)

FOREIGN PATENT DOCUMENTS

| | | |
|---|---|---|
| CH | 527493 A | 8/1972 |
| EP | 2063442 A1 | 5/2009 |
| EP | 2362407 A1 | 8/2011 |

OTHER PUBLICATIONS

International Preliminary Report on Patentability Application No. PCT/EP2013/052958 Completed: May 5, 2014 14 pages.

(Continued)

*Primary Examiner* — Truc Nguyen

(74) *Attorney, Agent, or Firm* — St. Onge Steward Johnston & Reens LLC

(57) ABSTRACT

A gas-insulated type circuit breaker including a housing defining a gas volume for a dielectric insulation gas; a first arcing contact member and a second arcing contact member, wherein the first arcing contact member and the second arcing contact member are movable relative to each other along an axis; a first nominal contact member and a second nominal contact member, wherein the first nominal contact member and the second nominal contact member are movable relative to each other along the axis; and a first nominal contact shielding arrangement including an inner shield member and an outer shield member, wherein the inner shield member and the outer shield member are arranged coaxially about the axis. The first nominal contact member is arranged co-axially between the inner shield member and the outer shield member, and is movable relative to the inner shield member and to the outer shield member.

22 Claims, 3 Drawing Sheets

(56) References Cited

U.S. PATENT DOCUMENTS

| | | | | |
|---|---|---|---|---|
| 4,128,748 | A * | 12/1978 | Lafferty | 218/126 |
| 5,578,806 | A * | 11/1996 | Hofbauer et al. | 218/59 |
| 2010/0224594 | A1* | 9/2010 | Uchii et al. | 218/52 |
| 2011/0155695 | A1* | 6/2011 | Bose | 218/51 |
| 2013/0048476 | A1* | 2/2013 | Kim | 200/50.21 |
| 2013/0270228 | A1* | 10/2013 | Nakada et al. | 218/158 |

OTHER PUBLICATIONS

International Search Report and Written Opinion of the International Searching Authority Application No. PCT/EP2013/052958 Completed: May 13, 2013; Mailing Date:May 21, 2013 7 pages.

* cited by examiner

GAS-INSULATED CIRCUIT BREAKER WITH NOMINAL CONTACT SHIELDING ARRANGEMENT

TECHNICAL FIELD

The present invention in general relates to circuit breakers and is especially applicable to high voltage circuit breakers. In particular, the present invention relates to a gas-insulated type circuit breaker having a pair of nominal contact members and a nominal contact shielding arrangement.

BACKGROUND OF THE INVENTION

High voltage (HV, herein defined as voltages of 72.5 kV or more) circuit breakers often interrupt electrical current by the separation of two arcing contact members—a first arcing contact member and a second arcing contact member—from one another. After the separation of the two arcing contact members, the electrical current continues to flow between them and is carried by an arc between the two contacts. For interrupting the current, the arc must be extinguished and re-ignition must be suppressed. In gas-insulated type circuit breakers, the arc is extinguished using a dielectric gas such as $SF_6$. The dielectric gas also reduces the risk of re-ignition and dielectric breakdown.

However, especially at higher voltages (e.g. 380 kV or more), there is a need for further reducing the risk of dielectric breakdown in various configurations of the circuit breaker. This risk can be reduced by increasing the distance between elements that are on different potentials within the circuit breaker. Such an increased distance, however, has a number of disadvantages such as more need for space and for insulation gas (e.g. $SF_6$), higher manufacturing cost, longer switching times and/or need for a stronger drive.

SUMMARY

Hence, there is a need for a circuit breaker with high dielectric strength even at higher voltages, but with a compact design. This object is achieved at least to some extent by the gas-insulated type circuit breaker according to independent circuit breaker claim and by the methods according to independent method claims. Further aspects, advantages, and features of the present invention are apparent from the claims, the description, and the accompanying drawings.

According to an embodiment, a gas-insulated type circuit breaker comprises a housing defining a gas volume for a dielectric insulation gas; a first arcing contact member and a second arcing contact member, wherein the first arcing contact member and the second arcing contact member are movable relative to each other along an axis; a first nominal contact member and a second nominal contact member, wherein the first nominal contact member and the second nominal contact member are movable relative to each other along the axis; and a first nominal contact shielding arrangement for electrically shielding the first nominal contact member comprising an inner shield member and an outer shield member. The inner shield member and the outer shield member are arranged coaxially about the axis. Further, the first nominal contact member is arranged co-axially between the inner shield member and the outer shield member and is movable relative to the inner shield member and to the outer shield member.

According to another embodiment, a method of breaking an electrical circuit using a gas-insulated circuit breaker is provided. The gas-insulated circuit breaker comprises a first nominal contact member, a second nominal contact member, a first arcing contact member and a second arcing contact member, an inner shield member and an outer shield member. The inner shield member and the outer shield member are arranged coaxially about the axis. The method comprises separating the first nominal contact member and the second nominal contact member from one another by relatively moving the first and second nominal contact members away from one another along an axis of the circuit breaker, thereby commuting a current from the first and second nominal contact members to the first and second arcing contact members; separating the first arcing contact member and the second arcing contact member from one another by relatively moving the first and second arcing contact members away from one another along the axis, thereby creating an arc between the first and second arcing contact members; moving the first nominal contact member relative to the inner shield member and to the outer shield member, thereby retracting the first nominal contact member axially away from the second nominal contact member into a volume (e.g. a volume provided co-axially) between the inner shield member and the outer shield member. Optionally, a particularly good electrical shielding is obtained, if the first nominal contact member is retracted axially more away from the second nominal contact member than the inner and outer shield member.

According to yet another embodiment, a method of closing a gas-insulated circuit breaker is provided. The gas-insulated circuit breaker comprises a first nominal contact member, a second nominal contact member, a first arcing contact member and a second arcing contact member, an inner shield member and an outer shield member. The inner shield member and the outer shield member are arranged coaxially about the axis. The method comprises: moving the first and the second arcing contact member towards one another along an axis of the circuit breaker; moving the first and second nominal contact members towards one another along the axis, thereby moving the first nominal contact member relative to the inner shield member and to the outer shield member, thereby protruding the first nominal contact member axially towards the second nominal contact member (i.e. protruding the first nominal contact member more towards the second nominal contact member than before) from a volume (e.g. a volume provided co-axially) between the inner shield member and the outer shield member; contacting the first arcing contact member with the second arcing contact member for creating a current path between the first and second arcing contact members; and contacting the first nominal contact with the second nominal contact for providing a current path, i.e. a direct current path via immediate contact touch and without intermediate arc, between the first and second nominal contact members.

The first nominal contact shielding arrangement allows to electrically shield the first nominal contact member effectively. In particular, since a relative motion is possible between the first nominal contact member on the one hand and the inner and outer shield members on the other hand, it is possible to adapt the shielding to the switch configuration, i.e. open nominal contact elements versus closed nominal contact elements, thereby obtaining an even more efficient shielding. For example, when the nominal contact elements are in an open configuration (in a configuration separated from each other), the first nominal contact element can be recessed and/or retracted axially behind the inner and/or outer shield member (here, behind means in a direction away from the second nominal contact). On the other hand, when the nominal contact elements are in a closed position or configuration (in a configuration contacting each other), the first nominal contact element can protrude axially from the inner and/or outer shield member in a direction towards the second nominal contact. This also allows good shielding in an intermediate configuration during the opening (or closing) of the circuit breaker, as well as in the open configuration, whereas the first nominal contact shielding arrangement does not disturb or get in the way in the closed configuration. Especially in the intermediate configuration, the shielding members allow coordinating the electrical field strengths at the nominal contact members with those at the arcing contact members in such a manner that re-ignition of an arc at the nominal contact members is avoided. Also, by reducing the overall electric stress at a given voltage, the circuit breaker may be operated reliably at an increased voltage.

BRIEF DESCRIPTION OF THE DRAWINGS

Typical embodiments are depicted in the drawings and are detailed in the description which follows. In the drawings:

FIGS. 2*b* and 2*c* in intermediate configurations; and FIG. 2*d* in an open configuration.

DETAILED DESCRIPTION OF EMBODIMENTS

Reference will now be made in detail to the various embodiments of the invention, one or more examples of which are illustrated in the figures. Within the following description of the drawings, the same reference numbers refer to same or similar components. Generally, only the differences with respect to individual embodiments are described. Each example is provided by way of explanation of the invention and is not meant as a limitation of the invention. Further, features illustrated or described as part of one embodiment can be used on or in conjunction with other embodiments to yield yet a further embodiment. It is intended that the description includes such modifications and variations.

Herein, the invention is explained by example of a high voltage circuit breaker, i.e. a circuit breaker being rated for a nominal voltage of 72,5 kV or more. In particular embodiments, the circuit breaker is rated for a nominal voltage of 420 kV or more, or even of 550 kV or more.

Figure 1A:
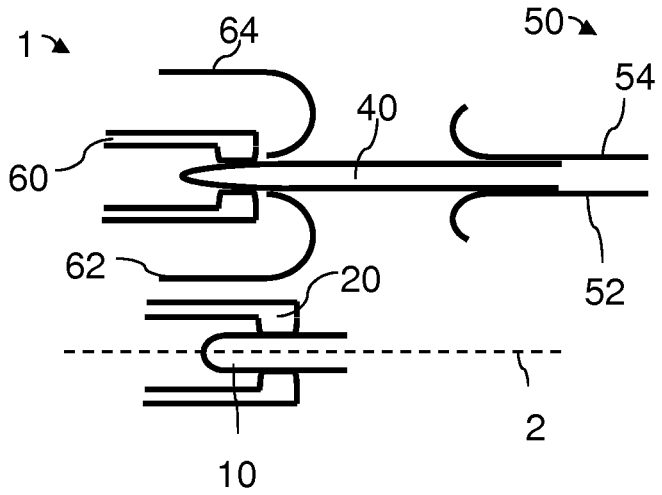
FIGS. 1*a* and 1*b* illustrate a cross-section of a circuit breaker according to an embodiment in a closed and open configuration, respectively.

FIG. 1*a* shows a cross-section of a portion of a gas-insulated circuit breaker 1 according to an embodiment of the invention. The circuit breaker 1 comprises a pair of arcing contact members 10 and 20, a pair of nominal contact members 40 and 60, a first nominal contact shielding arrangement 50 with an inner shield member 52 and an outer shield member 54, and a second nominal contact shielding arrangement with an inner shield member 62, and an outer shield member 64. Further, the circuit breaker 1 includes a housing (not shown) defining a gas volume for a dielectric insulation gas. The circuit breaker defines an axis 2, and its elements are generally arranged coaxially and with a substantial axial symmetry about the axis 2. The cross section in FIGS. 1*a* and 1*n* some other Figures does not show the symmetrically disposed features which are present on the other side of the axis 2.

According to an aspect, the inner shield member 52 and the outer shield member 454 are annular. Also, the inner shield member 62 and the outer shield member 64 can be annular. Herein, the term "annular" refers to any shape that substantially forms a ring around the axis 2. The ring does not need to be circular in shape and may be interrupted at some angular position(s) around the axis, as long as the general ring-like structure is maintained (e.g. as long as there are less interruption(s) than ring-like structures in term of angular extension about the axis). Preferably, the annular inner shield member 52 and outer shield member 54 (and possibly the shield members 62, 64) are co-axially arranged with each other and/or with the axis 2.

Figure 1B:
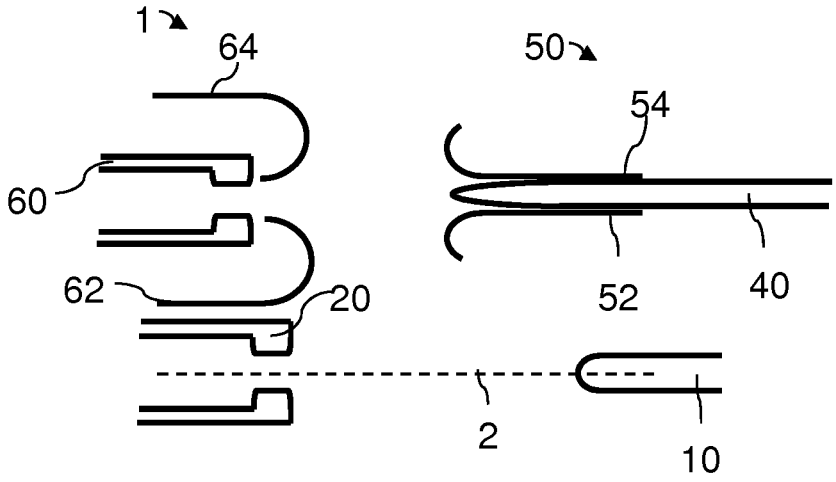

As a general aspect, the first nominal contact 40 may be a cylindrical tube, and the second nominal contact 60 may include contact fingers adapted for contacting the first nominal contact 40. In particular, the second nominal contact 60 may include inner and outer contact fingers concentrically arranged about the first nominal contact 40, such that the inner contact fingers are adapted to contact the first nominal contact 40 radially from the inside, and the outer contact fingers are adapted to contact the first nominal contact 40 radially from the outside. In this case, the nominal contacts 40, 60 are concentrically arranged such that the first nominal contact 40 is radially between the inner and outer contact fingers of the second nominal contact 60. This arrangement is shown in FIGS. 1*a* and 1*b*. Alternatively, the second nominal contact 60 may have only one of the inner or outer contact fingers of FIGS. 1*a* and 1*b*. The contact fingers can be attached to the second nominal contact member, or provided as a single-body integral part of the second nominal contact member 60. For example, the second nominal contact member 60 can be realized as a tube (possibly made of a metal sheet) in which axial slits are provided at an axial end. The contact fingers are then provided between these axial slits. Alternatively, the contacts can also be provided with the second nominal contact 60 being a cylindrical tube, and the first nominal contact 40 including contact fingers as described above.

The circuit breaker 1 of FIG. 1*a* is shown in a closed-switch configuration, also referred to as closed configuration. In the closed configuration, the nominal contact members 40 and 60 contact each other for letting a current flow between them, and also the arcing contact members 10 and 20 contact each other. Generally, the contact members of a pair of contact members are understood to be separable from each other for opening the circuit breaker, and connectable to each other for closing the circuit breaker.

The arcing contact members 10 and 20 are adapted for interrupting an arcing current between them. To this purpose, the arcing contact members 10 and 20, referred to as first arcing contact member 10 and second arcing contact member 20, are movable relative to each other along an axis 2. In this manner, the arcing contact members 10 and 20 can be selectively brought into contact with each other, as shown in FIG. 1*a*, or separated from each other, as shown in FIG. 1*b*. The arcing contact members 10 and 20 are adapted for withstanding an arc. Such an arc develops between them when the arcing contact members 10 and 20 are separated from each other while carrying an arc current (see the more detailed description below). Also, an arc may develop as a pre-arc shortly before the arcing contact members 10 and 20 are brought in contact with each other when the circuit breaker is closed.

The nominal contact members 40 and 60 are adapted for carrying a current between them and for disconnecting the current between them such that the current is commuted to the arcing contact members 10, 20: to this purpose, the nominal contact members 40 and 60, referred to as first nominal contact member 40 and second nominal contact member 60, are also movable relative to each other along the axis 2. In this manner, the nominal contact members 40 and 60 can be selectively brought into contact with each other for carrying the current, as shown in FIG. 1*a*, or separated from each other, as shown in FIG. 1*b*, e.g. when no current is carried between the nominal contact members 40 and 60.

During normal operation, the current flowing between the first and second nominal contact members 40, 60 is an operating current (under normal conditions, a current up to a rated current of the circuit breaker), but the nominal contact members 40, 60 may also support a higher current flowing between them, e.g. a short-circuit current, at least for a short time. In particular, the nominal contact members 40, 60 may support a service current or a short-circuit current prior to a circuit-breaking operation, when this current is then commuted to the arcing contact members 10, 20, as described above.

When the nominal contact members 40 and 60 are being separated from each other, a current flowing between the contact members 40 and 60 is commuted to the arcing contact members 10 and 20, where the current may be interrupted as described further below. To this purpose, the pair of nominal contact members 40, 60 is electrically connected in parallel to the pair of arcing contact members 10, 20.

The second nominal contact member 60 is shown as a double-contact member: It has two members (an inner member disposed closer to the axis 2 than an outer member) coaxially extending about the axis 2 and defining a gap between them. The first nominal contact member 40 is insertable into this gap, such that in a closed position, a radially outwardly oriented face of the first nominal contact member 40 contacts a radially inwardly oriented face of the second nominal contact's outer member, and a radially inwardly oriented face of the first nominal contact member 40 contacts a radially outwardly oriented face of the second nominal contact's inner member. Thus, the double-contact second nominal contact member 60 contacts the first nominal contact member 40 at two opposite radial sides (at a radial inward side and at a radially outward side of the first nominal contact member 40).

While FIGS. 1*a* and 1*b* show the two members of the double-contact second nominal contact member 60 as having about the same axial position, in an alternative embodiment these two members (inner and outer member) of the second nominal contact member 60 may be axially displaced with respect to one another. In this manner, the two parts are not separated at the same time from the first nominal contact member 40: an arc during current commutation then only develops when the last part of the second nominal contact member 60 is separated from the first nominal contact member 40. An effect of this embodiment is that the other part (the part already separating earlier) is not degraded by the arc and thus maintains good nominal-current-carrying properties more reliably.

In an alternative embodiment, the second nominal contact member 60 can also be realized as a single-contact member, i.e. having only one area at which it contacts the first nominal contact member 40. Such a single-contact member can be, e.g., the second nominal contact member 60 having only the outer member or only the inner member shown in FIGS. 1*a* and 1*b*.

The first and second nominal contact members 40, 60 contact each other at radial sides thereof (i.e. at a radially inner and/or outer side thereof). This allows for a good electrically conductive contact even under adverse circumstances, such as an uneven or damaged contact member or tolerances.

The first nominal contact shielding arrangement 50 is arranged for electrically shielding the first nominal contact member 40. Herein, a shielding arrangement (or shield/shielding members) are understood to be structures which reduce the electrical field on a shielded element. To this purpose, the shield may cover the shielded element at least partially, and be adapted to be held at the same or similar electrical potential (voltage) as the shielded element. Thus, a shielding arrangement or shielding member reduces the electrical stress for a given voltage, and thereby allows higher voltages to be applied at a given acceptable value of electrical stress (electrical field magnitude).

In an embodiment, the inner shield member 52 and the outer shield member 54 of the shielding arrangement 50 are arranged coaxially about the axis 2 and sandwich the first nominal contact member 40 between them: Thus, the first nominal contact member 40 is arranged co-axially between the inner shield member 52 and the outer shield member 54.

More precisely, the inner shield member 52 is arranged on a radially inner side directly adjacent to the first nominal contact member 40. Here, directly adjacent means that there is an axial section with no other element between them except possibly a gap, guiding structures or electrical contacts. Likewise, the outer annular shield member 54 is arranged on a radially outer side directly adjacent to the first nominal contact member 40.

In other words, the inner contact shield member 52 is arranged adjacent to an axis-facing side of the first nominal contact member 40, and the outer contact shield member 54 is arranged coaxially about the axis adjacent to an away-from-axis-facing side of the first nominal contact member 40.

The inner shield member 52 is arranged radially between the first arcing contact member 10 and the first nominal contact member 40. The outer shield member 54 is arranged radially between the first nominal contact member 40 and the housing (i.e. the containment for the insulating gas).

The shield members 52 and/or 54 may comprise any material which provides suitable shielding. For example, the shield members 52 and/or 54 may comprise conducting material such as metal or conductive polymer. In particular, the shield members 52, 54, and optionally 62, 64 may be formed from a sheet metal. The shield members 52 and/or 54 may also comprise a dielectric with a conductive coating. The shield members 52 and/or 54 may be smoother than the shielded structure and may be free from any kink on its surface (except possibly at an end of the surface), wherein a kink is defined as a structure having a radius of curvature of less than 1 mm.

The first nominal contact member 40 is movable, along the axis 2, relative both to the inner shield member 52 and to the outer shield member 54. Thereby, as is described below with reference to FIG. 1*b* in more detail, it is possible to shield the first nominal contact member 40 efficiently and to thereby obtain an excellent dielectric strength even at higher voltages.

Guiding and driving structures which allow the movement of the arcing contact members 10, 20, the nominal contact members 40, 60 and the shield members 52, 54, 62, 64 are not shown and may be implemented in any known manner.

The shield members 52, 54 are advantageously held at the same electrical potential as the first nominal contact member 40. To this purpose, the shield members 52, 54 may be electrically connected to the first nominal contact member 40. This electrical contact can be established e.g. by means of a contact brush, a spring contact, a flexible wiring or any other manner that allows electrical or galvanic contacting and at the same time relative motion. Likewise, the shield members 62, 64 may be electrically connected to the second nominal contact member 60 in a similar manner. If no relative motion is required between these members 60, 62, 64, then the connection can be implemented in an even simpler manner, e.g. by a fixed electrical connection.

The shield members have the following advantage: Over time, the surface of the nominal contact member 40 (and 60) is roughened due to commutation arcs which develop between the nominal contact members 40, 60 when they separate and the current is commuted to the arcing contact members 10, 20. These commutation arcs lead to cusps or similar rough structures. If exposed to high electric fields, unwanted electrons or other charge-carriers may be emitted from these rough structures. The shield reduces this exposure to high electric fields, especially if the shield is set to a voltage or potential similar to the shielded element (here: nominal contact member 40). Then, only the relatively smooth shield, but not the shielded element, is exposed to the high electric fields. As a general aspect of the invention, the surface of the shield member 52 is formed such that the maximum field strength at the shield member 52 and at the shielded element (here: first nominal contact element 40) is lower than the maximum filed strength which would be present at the shielded element in the absence of the shield member 52. A similar condition applies to any other shield member described herein, i.e. to the shield members 54, 62 and/or 64.

Further, due to the shield members 52, 54 (and 62, 64) and to the ability of the first nominal contact member 40 to be retracted behind the shield members 52, 54, the field strength at the first nominal contact member 40 is reduced substantially, especially during the opening of the circuit breaker and in the open configuration, when the nominal contact members 40, 60 are separated from each other. Thereby, it is ensured that in any configuration of the circuit breaker the field strength at the nominal contact member 40 (and 60) is lower than the field strength at the arcing contact members 10 and 20, even if, e.g., the surface of the nominal contact member 40 (and 60) should be roughened due to commutation arcs, which occurred in previous switching operations. In particular, the inner shield 52 shields the nominal contact member 40, and also the arcing contact member 10. This lower field strength has the effect of reducing the risk of a dielectric failure between the arcing contact members 10 and 20 during a breaking operation, and of reducing the pre-arcing distance during the closing of the circuit breaker. Thereby, the switching properties are improved, especially at higher voltages.

Hence, as a general aspect of the invention, the shield member 52 (and 54 and, if present, 62 and/or 64) are arranged such that in any configuration of the circuit breaker the field strength at the nominal contact member 40 (and 60) is lower than the field strength at the arcing contact members 10 and 20, preferably by 20% or more.

The second nominal contact shielding arrangement, with the inner shield member 62 and the outer shield member 64, is arranged for electrically shielding the second nominal contact member 60.

The inner shield member 62 and the outer shield member 64 are arranged coaxially about the axis 2 and sandwich the second nominal contact member 60 between them: Thus, the second nominal contact member 60 is arranged co-axially between the inner shield member 62 and the outer shield member 64. More precisely, the inner shield member 62 is arranged on a radially inner side directly adjacent to the second nominal contact member 60, and the outer shield member 64 is arranged on a radially outer side directly adjacent to the second nominal contact member 60.

The inner shield member 62 is arranged radially between the second arcing contact member 20 and the second nominal contact member 60. The outer shield member 64 is arranged radially between the second nominal contact member 60 and the housing. Thereby, the inner shield member 62 shields both the second arcing contact member 20 and the second nominal contact member 60, and the outer shield member 64 shields the second nominal contact member 60.

FIG. 1*b* shows the circuit breaker 1 of FIG. 1*a* in an open-switch configuration, also referred to as open configuration. In the open configuration, the nominal contact members 40 and 60 are separated from one another for not letting a current flow (directly via galvanic contact) between them, and also the arcing contact members 10 and 20 are separated from each other. The detailed process of opening and closing the circuit breaker, i.e. of going from the closed configuration of FIG. 1*a* to the open configuration of FIG. 1*b* and back, is analogous to the process described in more detail below with respect to FIGS. 2*a* to 2*d*.

In comparison to the closed configuration of FIG. 1*a*, in the open configuration of FIG. 1*b* the first nominal contact member 40 and the first arcing contact member 10 have been moved away, along the axis 2, from the second nominal contact member 60 and the second arcing contact member 20, respectively (i.e. to the right in FIG. 1*b*). Thereby, the relative position of the second arcing contact member 20, the second nominal contact member 60, and the shield members 62 and 64 is unchanged: these members are attached to each other such as to retain their relative position with respect to one another when the switch is moved between the closed and the open configuration. In an alternative embodiment, they may be movable with respect to each other, but less so in comparison to the movement of the first and second nominal contact members 40, 60 and/or in comparison to the movement of the first and second arcing contact members 10, 20.

As can be seen in FIG. 1*b*, the first nominal contact member 40 and the first arcing contact member 10 are movable not only relative to the second arcing contact member 20 (and thereby to all of the members attached to the second arcing contact member 20), but they can also be moved relative to one another: thus, there are at least three groups of members movable differently from one another. The second arcing contact member 20 and all members attached to it belonging to a first group; the first arcing contact member 10 belonging to a second group, and the first nominal contact member 40 belonging to a third group. Each of the shield members 52 and 54 belong to a group different from the first nominal contact member 40. This can be the first group, the second group, or an additional (fourth or fifth) group, respectively.

Alternatively, the first nominal contact member 40 and the first arcing contact member 10 may also be fixed relative to each other and be movable jointly, as a first group. Also, the second nominal contact member 60 and the second arcing contact member 20 (and optionally also the shield members 62 and 64, if present) may be fixed relative to each other and be movable jointly, as a first group. The nominal contacts 40, 60 are placed at a larger distance from each other than the arcing contacts 10, 20, such that the nominal contacts 40, 60 separate from each other before the arcing contacts 10, 20. The shield member 52 (and, if present, also shield member 54) may be fixed to each other and be movable jointly, as a third group. For example, the first group may be directly driven by a drive, and the second and third group may be driven indirectly by the drive via a gear.

There may be additional groups of independently movable members. For example, the shield members 52 and/or 54 can be adapted to move independently from the second arcing contact member 20 as well, and there may be a fourth group including e.g. the inner shield member 52 and/or a fifth group including e.g. the outer shield member 54.

Likewise, the second-contact inner shield member 62 and/or the second-contact outer shield member 64 can be attached to the second arcing contact member 20 and/or second nominal contact member 60 to be jointly movable with the second arcing contact member 20 and/or second nominal contact member 60, respectively. Alternatively, the second-contact inner shield member 62 and/or the second-contact outer shield member 64 may be movable with respect to the second arcing contact member 20 and/or second nominal contact member 60, respectively.

The fact that various contact members of the circuit breaker are movable with respect to each other allows for great flexibility for arranging the elements in an advantageous way depending on whether the circuit breaker is in an open or in a closed configuration. This applies in particular to the first nominal contact member 40 which is movable relative to the inner shield member 52 and to the outer shield member 54: The relative movability of these members allows good shielding in an intermediate configuration during the opening (or closing) of the circuit breaker, as well as in the open configuration, whereas the first nominal contact shielding arrangement does not disturb or get in the way in the closed configuration. Especially in the intermediate configuration, the shielding members allow coordinating the electrical field strengths at the nominal contact members with those at the arcing contact members in such a manner that re-ignition of an arc at the nominal contact members is avoided. Also, by reducing the overall electric stress at a given voltage, the circuit breaker may be operated reliably at an increased voltage.

Previously, such an amount of independently movable contact members and—especially—independently movable shield members were not considered, in view of the additional complexity of the circuit breaker due to these moving parts. However, according to the present invention it was realized that precisely an independent motion of contact member 40 on the one hand, and shield members 52 and 54 on the other hand, improves the dielectric strength significantly and to a surprising degree, and thereby allows a high voltage in a compact design.

The shielding can be obtained in a particularly efficient manner if the switch is configured—as is illustrated in FIGS. 1*a* and 1*b*—such that in the closed configuration, the first nominal contact member 40 protrudes more from the inner and outer shield member 52, 54 axially towards the second nominal contact member 60 than in an open configuration. In this manner, in the closed configuration there can be unobstructed contact between the nominal contact members 40 and 60, for carrying a current between them; and in the open configuration, the first nominal contact member 40 is shielded efficiently by the shield members 52, 54. In the open configuration, the first nominal contact member 40 possibly does not protrude at all from the shield members 52, 54, but is retracted axially flush with or behind at least one of the inner and outer shield members 52, 54, in a direction away from the second nominal contact member 60.

In an embodiment, the circuit breaker is of double-motion type. This means that both the first arcing contact member 10 and the second arcing contact member 20 are movable with respect to the housing 4. In addition, at least one of the first nominal contact member 40 and the second nominal contact member 60 can be movable with respect to the housing 4. In the embodiment of FIGS. 1*a* and 1*b*, the second nominal contact member 60 is movable with respect to the housing 4. For especially fast circuit breaking, the circuit breaker may be of full-double-motion type, i.e. such that both the first nominal contact member 40 and the second nominal contact member 60 are movable with respect to the housing 4.

For driving the movable contact members, a contact member driving arrangement (not shown) is provided. Details of the driving arrangement of a circuit breaker, which are in principle known, are not described herein. For example, in a full-double-motion configuration, the contact member driving arrangement is adapted for driving the first arcing contact member 10 and the first nominal contact member 40 (which may be fixedly connected to each other as described above) in a first direction along the axis 2 (to the right in FIGS. 1*a* and 1*b*), and the second arcing contact member 20 and the second nominal contact member 60 (which may also be fixedly connected to each other as described above) in a second direction opposite to the first direction along the axis 2 (to the left in FIGS. 1*a* and 1*b*) for opening the circuit breaker.

As a further general aspect, the contact member driving arrangement may be configured such that the first arcing contact member 10 and the second arcing contact member 20 have mutually different motion profiles. Herein, a motion profile is understood to represent a displacement (generally along the axis 2) as a function of time, or as a function of the displacement of the driven side, or as a function of another time- or displacement-derived equivalent parameter. Such different motion profiles can be achieved, e.g., by means of a gear which couples the motion of the first arcing contact member 10 with that of the second arcing contact member 20, the gear having a gear ratio different from one (i.e. different from one at least during some time of the movement; preferably even during a major part of the movement). The gear may be set, but need not be set, such that the first nominal contact member 40 and the first arcing contact member 10 are moved in the same direction during the entire circuit breaking.

The first nominal contact member 40 may further have a motion profile different from both that of the first arcing contact member 10 and that of the second arcing contact member 20, or may be jointly movable with the first arcing contact member 10 and thus have the same motion profile as the first arcing contact member 10.

FIGS. 2*a* to 2*d* show portions of a circuit breaker according to another embodiment. Therein, elements corresponding to those shown in FIGS. 1*a* and 1*b* are assigned the same reference signs, and the description of FIGS. 1*a* and 1*b* applies to FIGS. 2*a* to 2*d*, as well. In the following, only additional elements or other differences with respect to FIGS. 1*a* and 1*b* are explained.

Figure 2A:
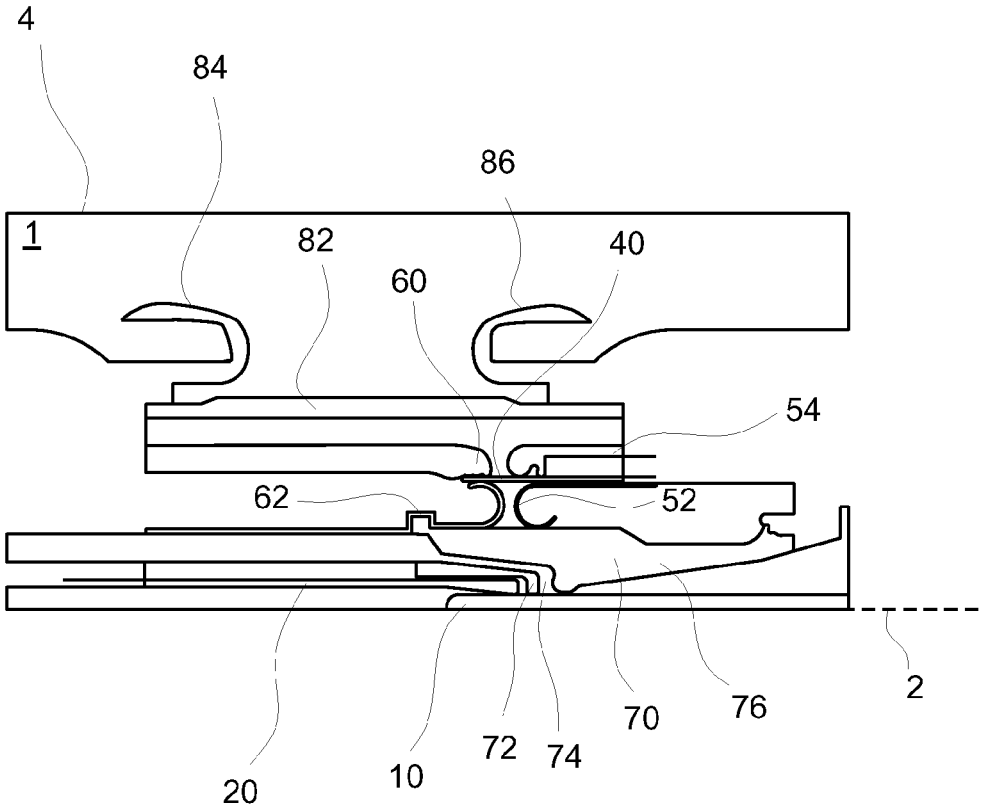
FIGS. 2*a* to 2*d* illustrate a cross-section of a circuit breaker according to another embodiment in various configurations, namely FIG. 2*a* in a closed configuration.

FIG. 2*a* shows the circuit breaker 1 in a closed configuration. In addition to the elements already shown in FIGS. 1*a* and 1*b*, such as the axis 2, FIG. 2*a* shows a portion of the housing 4 of the circuit breaker and a chamber insulator 82 with chamber insulator holders 84, 86 for additional dielectric and mechanical strength (the chamber insulator 82 may alternatively also be replaced by separate insulating rods). Further, the outer shield 64 from FIG. 1*a* is omitted. Instead, the second nominal contact member 60 is shaped with a smooth radial outer side (upper side in FIG. 2*a*), for avoiding small curvatures. When using such a shape, the maximum field strength on the outer side of the second nominal contact member 60—and hence the necessity of a shielding on that outer side—can be reduced. The inner part of the second nominal contact member 60 can be realized as a solid tube, whereas the outer part can be realized as a tubular sheet which is attached to the tube.

In an alternative embodiment, the second nominal contact member 60 may be replaced by the double-contact (-finger) arrangement and/or by a single contact, as described above with respect to FIG. 1. Also, optionally the shield members 62 and/or 64 shown in FIG. 1 may be provided, as described above with respect to FIG. 1.

Figure 2B:
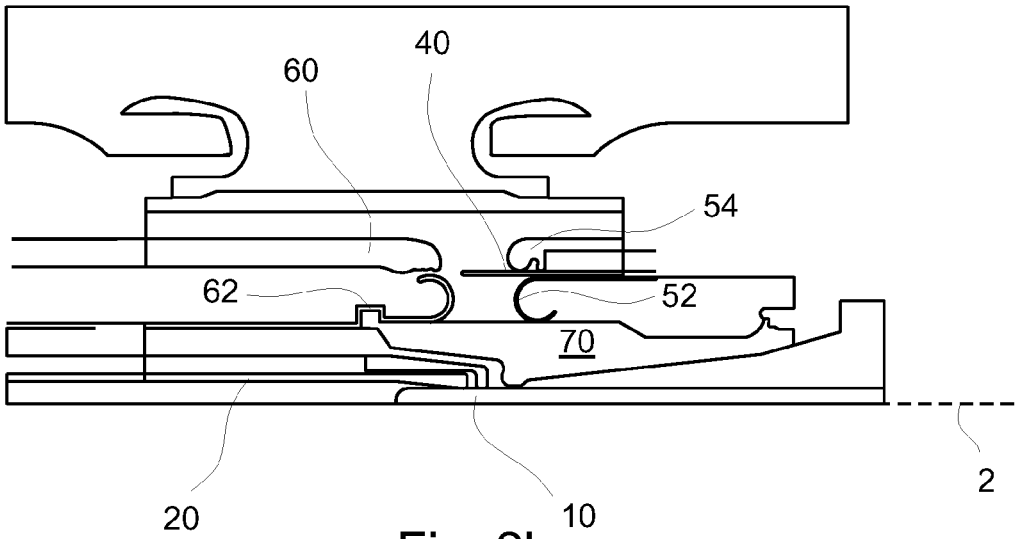
Figure 2C:
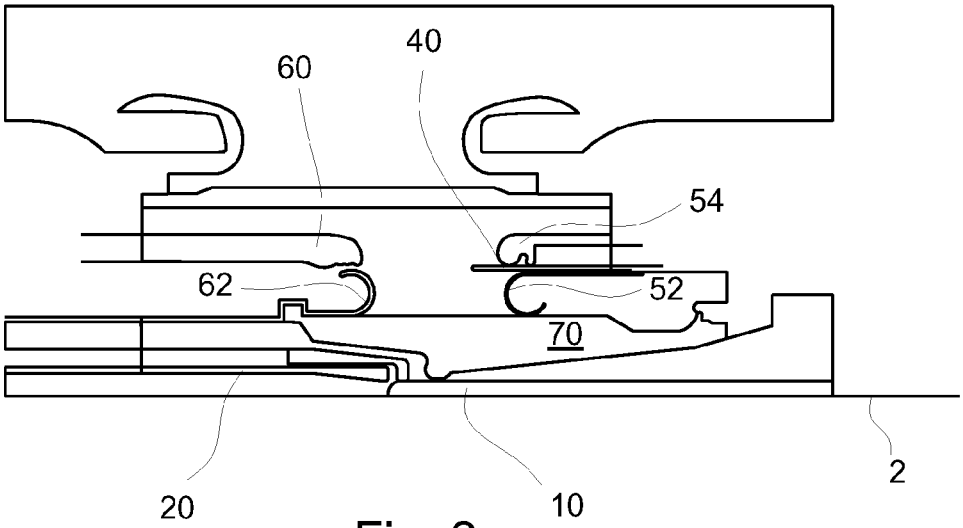

The shield member 54 is shown in FIGS. 2*a* to 2*d* only schematically. The shield member 54 contacts the first nominal contact member 40 electrically. This electrical contact can be established e.g. by a contact finger or a contact spiral. If it is desired that the contact-establishing element (e.g. contact spiral) is in permanent contact with the first nominal contact member 40, then the first nominal contact member 40 should have a length which is at least as long as the relative displacement between the shield member 54 and the nominal contact member 40. For reducing the length (and thereby mass) of the first nominal contact member 40, in an embodiment, the relative displacement can be reduced, e.g., by moving the shield member 54 and the first nominal contact member 40 relative to each other only during a part of the switching operation (e.g. retracting the nominal contact member 40 behind the shield until the configuration of FIG. 2*c* is reached), and by moving them jointly during the remaining part of the switching operation (between FIG. 2*c* to FIG. 2*d*). Alternatively, the first nominal contact member 40 may be kept short and the contact with the shield member 54 may be established by a finger or the like only temporarily, during a portion of the operation at which the shielding is important.

The shield members 52 and/or 54 can be formed from a metal sheet. The shield member 52 is also in electrical contact with the first nominal contact member 40, either via e.g. a separate spring contact or the like, or via the shield member 54.

The shield member 62 can be jointly movable with and in electrical contact with the second nominal contact member 60 (electrical connection not shown).

Further, FIG. 2*a* shows a nozzle system 70 which is attached to the second arcing contact member 20. The nozzle system 70 has a main nozzle body 76 and a complementary nozzle body 72 which define, between them, a channel 74 adapted for carrying an arc-extinguishing flow of dielectric gas directed to an arc between the arcing contact members 10, 20. In particular, the nozzle system 70 may be a self-blast nozzle system.

The nozzle system 70 is arranged coaxially about the axis 2 and has in its middle a channel opening in which the first arcing contact member 10 can move along the axis 2. As a general aspect, the nozzle system 70 is arranged between (e.g. sandwiched by) the first arcing contact member 10 and the shielding member 52. On the second-contact side, the nozzle system 70 is arranged between (e.g. sandwiched by) the second arcing contact member 20 and the shielding member 62.

The second-contact inner shield member 62 is thus arranged radially between the nozzle assembly 70 and the second nominal contact member 60. The second arcing contact member 20, the second nominal contact member 60, the second-contact inner shield member 62 and the nozzle assembly 70 can be attached to one another and can be jointly moveable together.

Next, a circuit-breaking operation of the circuit breaker 1 is described. The circuit-breaking operation starts in the closed configuration shown in FIG. 2*a*, with the intermediate configurations of FIGS. 2*b* and 2*c*, and results in the open configuration shown in FIG. 2*d*.

Starting from FIG. 2*a*, the first and second nominal contact members 40, 60 are separated from one another by relatively moving the first and second nominal contact members 40, 60 away from one another along the axis 2, resulting in the intermediate configuration of FIG. 2*b* in which these contact members 40, 60 are separated from one another. In the double-motion type device illustrated in FIG. 2*a*-2*d*, the first nominal contact member 40 is moved to the right, whereas the second nominal contact member 60 is moved to the left relative to the housing 4; but in principle, in a less efficient but possible variant, only one of these movements could be carried out.

When the nominal contact members 40, 60 are separated from one another (FIG. 2*b*), a current (e.g. operating current or short-circuit current) is commuted from the first and second nominal contact members 40, 60 to the first and second arcing contact members 10, 20 which still contact each other. Due to inductances of the current path through the arcing contacts 10, 20, a current may nevertheless be carried in an arc developing, for a short time, between the nominal contact members 40, 60.

Then, going from FIG. 2*b* to FIG. 2*c*, the first and second arcing contact members 10, 20 are separated from one another by relatively moving the first and second arcing contact members 10, 20 away from one another along the axis 2: the first arcing contact member 10 is moved to the right, whereas the second arcing contact member 20 is moved to the left relative to the housing 4 (again, alternatively only one of these movements could be carried out). When the arcing contact members 10, 20 are separated in this manner, an arc (not shown) is created between them. The arc is subsequently extinguished by a flow of extinguishing gas through the nozzle system 70.

Figure 2D:
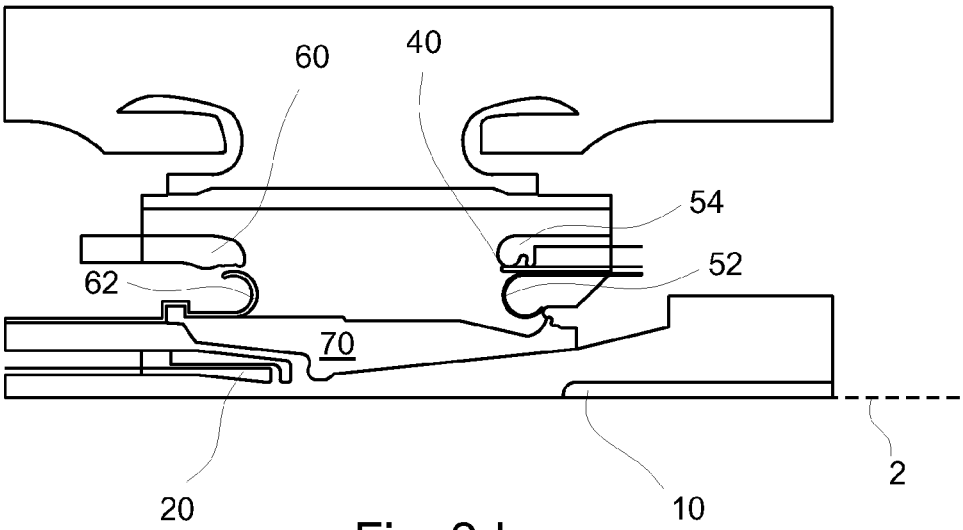

Then, going to FIG. 2*d*, the arcing contact members 10, 20 are further moved away from one another, and likewise also the nominal contact members 40, 60 are further moved away from one another. The first nominal contact member 40 is thereby moved relative to the shield members 52, 54 such as to be retracted behind these shield members 52, 54 (e.g., into a volume provided co-axially between the inner shield member 52 and the outer shield member 54). By being moved axially away from the second nominal contact member 60 behind the inner and outer shield members 52, 54, the first nominal contact member 40 (or members 40, 60) is (or are) shielded very efficiently by the shield members 52, 54, and the risk of dielectric breakdown is reduced. In particular, especially the shield 52 ensures that the electrical field strength at the nominal contact member 40 (and 60) is lower than the electrical field strength at the arcing contact members 20, 40, even when the arcing contact members 20, 40 have been moved away from each other as shown in FIG. 2*d*. To this purpose, the nominal contact member 40 is moved axially behind (to the right in FIG. 2*d*) the shield member 52 to be effectively shielded.

As a general aspect, for obtaining a good shielding especially at the later phase of the circuit breaking (shown in FIG. 2*c*), the shielding member 52 may also have a motion profile with a direction reversal, such that at an earlier stage of the circuit breaking the shielding member 52 moves in the opposite direction (to the left in FIGS. 2*a*-2*c*) than the nominal contact member 40, whereas at a later stage of the circuit breaking (shown in FIG. 2*d*) the shielding member 52 moves in the same direction as the nominal contact member 40 (to the right in FIG. 2*d*).

When closing the circuit breaker again, these steps are done in reverse order: starting from FIG. 2*d*, the first and a second arcing contact member 10, 20 are moved towards one another along the axis 2; and the first and second nominal contact members 40, 60 are also moved towards one another along the axis 2. Thereby, the first nominal contact member 40 is moved relative to the shield members 52, 54, such that the first nominal contact member 40 protrudes, from a volume between the inner shield member 52 and the outer shield member 54, axially more towards the second nominal contact member 60 than before (as can be seen by comparing FIG. 2*c* with FIG. 2*d*). As a result, the first nominal contact member 40 also protrudes more than the inner and outer shield member 52, 54 (FIG. 2*c*).

The arcing contact members 10, 20 are then moved towards one another to such an extent that they contact each other, thereby providing a current path between them (FIG. 2*b*). If the circuit breaker is under voltage, when the arcing contact members 10, 20 are close to each other but not contacting each other yet, high electrical field strengths may lead to a pre-arc developing between the arcing contact members 10, 20, which burns until the arcing contact members 10, 20 contact each other. Finally, also nominal contact members 40, 60 are moved towards one another to such an extent that they contact each other, thereby creating a current path between them (FIG. 2*a*).

The above description of the circuit-breaking operation and the closing operation also applies to any embodiment illustrated by FIGS. 1*a* and 1*b*, for which the intermediate configurations are, however, not shown.

Next, a few further possible general features are described, which may be applied independently of each other to any embodiment described herein. The circuit breaker may comprise a drive unit for driving the first arcing contact member 10, the second arcing contact member 20, and at least one of the first nominal contact member 40 and the second nominal contact member 60. The drive unit may be dimensioned for performing a circuit breaking operation within two AC cycles.

Generally, the first arcing contact member 10, the second arcing contact member 20, and at least one of the first nominal contact member 40 and the second nominal contact member 60 are movable relative to the housing 4 along the axis 2. Additionally or alternatively, also the inner shield member 52 and/or the second-contact inner shield member 62 are movable relative to the housing 4 along the axis 2. In contrast, the outer shield member 54 may be fixed with respect to the housing 4. The term "movable" generally relates to movability relative to the housing 4. However, the term "movable independently" or "movable differently" indicates relative movement between elements and may even comprise one element to be fixed or to be motionless (relative to the housing 4 at least for a certain period in time during a breaking or making operation.

All contact members may be arranged coaxially about the axis 2.

The inner shield member 52 may be arranged on a radially inner side directly adjacent to the first nominal contact member 40, and/or the outer shield member 54 may be arranged on a radially outer side directly adjacent to the first nominal contact member 40.

Generally, the second-contact inner and shield member 62 and optionally second-contact outer shield member 64 of the second nominal contact shielding arrangement 62, 64 may have any of the characteristics of the shield members 52 and/or 54 of the first nominal contact shielding arrangement 50 described herein.

Next, a few possible variations of any of the above-described embodiments are described. One or both of the second-contact inner shield member 62 and second-contact outer shield member 64 can also be omitted.

The nominal contact member 60 is shown as a double-contact member. Alternatively, the nominal contact member 60 may only have (consist of) one of these double contacts, either at the radial inward side or at the radially outward side of the nominal contact member 40.

As a general aspect, a good electrically conductive contact even under adverse circumstances, such as an uneven or damaged contact member and/or high mechanical tolerances, can be obtained if the first and second nominal contact members 40, 60 contact each other at radial sides thereof (i.e. at a radially inner and/or outer side).

The two parts (inner and outer part) of the second nominal contact member 60 (see FIG. 1*a*) may be axially displaced with respect to one another. In this manner, the two parts are not separated at the same time from the first nominal contact member 40. An arc during current commutation then only develops in one of the parts, whereas the other part is not degraded by the arc and keeps good current-carrying properties.

These variations illustrate that other and further embodiments of the invention may be devised without departing from the basic scope thereof. The scope is determined by the claims that follow.

The invention claimed is:

1. A gas-insulated type circuit breaker comprising:

a housing defining a gas volume for a dielectric insulation gas;

a first arcing contact member and a second arcing contact member, wherein the first arcing contact member and the second arcing contact member are movable relative to each other along an axis;

a first nominal contact member and a second nominal contact member, wherein the first nominal contact member and the second nominal contact member are movable relative to each other along the axis; and a first nominal contact shielding arrangement for electrically shielding the first nominal contact member, the first nominal contact shielding arrangement comprising an inner shield member and an outer shield member, wherein the inner shield member and the outer shield member are arranged coaxially about the axis, the first nominal contact member is arranged co-axially between the inner shield member and the outer shield member and is movable relative to the inner shield member and to the outer shield member and wherein the inner and outer shield members are held at the same electrical potential as the first nominal contact member.

2. The gas-insulated type circuit breaker according to claim 1, wherein the inner shield member is arranged on a radially inner side directly adjacent to the first nominal contact member, and/or wherein the outer shield member is arranged on a radially outer side directly adjacent to the first nominal contact member.

3. The gas-insulated type circuit breaker according to claim 1, wherein the first arcing contact member, the second arcing contact member, and at least one of the first nominal contact member and the second nominal contact member are movable relative to the housing along the axis.

4. The gas-insulated type circuit breaker according to claim 1, further comprising a drive unit, in particular a direct drive and an auxiliary gear, for driving the first arcing contact member, the second arcing contact member, and at least one of the first nominal contact member and the second nominal contact member with respect to the housing, and in particular the drive unit being dimensioned for performing a circuit breaking operation within two AC cycles, and further in particular the circuit breaker being adapted for a nominal voltage of 420 kV or more, or even of 550 kV or more.

5. The gas-insulated type circuit breaker according to claim 1, further comprising an insulating nozzle assembly, which is attached to the second arcing contact member, and which is coaxially arranged about the axis at a radial position between the second arcing contact member and the second nominal contact member.

6. The gas-insulated type circuit breaker according to claim 1, further comprising a second-contact inner shield member arranged coaxially about the axis radially inward of the second nominal contact member, and optionally a second-contact outer shield member arranged coaxially about the axis radially outwardly of the second nominal contact member.

7. The gas-insulated type circuit breaker according to claim 1, wherein three groups of members are movable differently from one another, the first group comprising the second arcing contact member and members attached to it, the second group comprising the first arcing contact member, and the third group comprising the first nominal contact member, and wherein each of the inner and outer shield members belongs to a group different from the third group, in particular belongs to the first group or the second group or an additional fourth or fifth group.

8. The gas-insulated type circuit breaker according to claim 1, wherein the first nominal contact member and the first arcing contact member are fixed relative to each other and are jointly movable; and/or wherein the second nominal contact member and the second arcing contact member are fixed relative to each other and are jointly movable; and/or the inner shield member and the outer shield member are fixed to each other and are jointly movable.

9. The gas-insulated type circuit breaker according to claim 1, wherein the shield members are electrically connected to the first nominal contact member, in particular wherein this electrical contact is established by a contact brush or a spring contact or a flexible wiring or any other manner that allows electrical or galvanic contacting and at the same time relative motion.

10. The gas-insulated type circuit breaker according to any of the claims 1-3, wherein the inner shield member is movable relative to the housing along the axis, and in particular wherein the outer shield member is fixed with respect to the housing.

11. The gas-insulated type circuit breaker according to claim 4, the drive unit further comprising a contact member driving arrangement for driving the first arcing contact member and the first nominal contact member in a first direction along the axis, such that the first nominal contact member moves relative to the inner shield member and the outer shield member, and for driving the second arcing contact member and the second nominal contact member in a second direction, in particular in a second direction opposite to the first direction, along the axis for opening the circuit breaker, such that the first arcing contact member and the second arcing contact member have mutually different motion profiles.

12. The gas-insulated type circuit breaker according to claim 6, wherein the second-contact inner shield member and/or second-contact outer shield member are fixed to and jointly movable with the second arcing contact member and/or second nominal contact member, or are movable independently from the second arcing contact member and/or second nominal contact member.

13. The gas-insulated type circuit breaker according to claim 11, wherein the drive unit provides a motion profile with a direction reversal, in particular a direction reversal of the inner shield member.

14. The gas-insulated type circuit breaker according to claim 13, wherein the inner shield member has a motion profile with a direction reversal, such that at an earlier stage of the circuit breaking the inner shield member moves in an opposite direction to the nominal contact member, whereas at a later stage of the circuit breaking the inner shield member moves in the same direction as the nominal contact member.

15. The gas-insulated type circuit breaker according to claim 11, further comprising a second-contact inner shield member arranged coaxially about the axis radially inward of the second nominal contact member, and optionally a second-contact outer shield member arranged coaxially about the axis radially outwardly of the second nominal contact member.

16. The gas-insulated type circuit breaker according to any one of the claims 1, 4, and 11, further comprising a first nominal contact driving mechanism configured for driving the first nominal contact member to protrude more from the inner and outer shield member axially towards the second nominal contact member in a closed configuration than in an open configuration.

17. The gas-insulated type circuit breaker according to any of the claims 6-12, wherein the second-contact inner shield member and the second-contact outer shield member are electrically connected to the second nominal contact member.

18. The gas-insulated type circuit breaker according to claim 16, wherein the first nominal contact driving mechanism is configured for driving the first nominal contact member to be retracted axially flush with or behind at least one of the inner shield member and outer shield member, in a direction away from the second nominal contact member, in an open switch configuration.

19. The gas-insulated type circuit breaker according to any of the claims 6-12, wherein the second-contact inner shield member is movable relative to the housing along the axis.

20. A method of breaking an electrical circuit using a gas-insulated circuit breaker, the gas-insulated circuit breaker comprising a first nominal contact member, a second nominal contact member, a first arcing contact member and a second arcing contact member, an inner shield member and an outer shield member, wherein the inner shield member and the outer shield member are arranged coaxially about an axis, the method comprising:

separating the first nominal contact member and the second nominal contact member from one another by relatively moving the first and second nominal contact members away from one another along the axis of the circuit breaker, thereby commuting a current from the first and second nominal contact members to the first and second arcing contact members;

separating the first arcing contact member and the second arcing contact member from one another by relatively moving the first and second arcing contact members away from one another along the axis, thereby creating an arc between the first and second arcing contact members; and moving the first nominal contact member relative to the inner shield member and to the outer shield member, thereby retracting the first nominal contact member axially away from the second nominal contact member into a volume between the inner shield member and the outer shield member, wherein further the inner and outer shield members are held at the same electrical potential as the first nominal contact member.

21. A method of closing a gas-insulated circuit breaker, the gas-insulated circuit breaker comprising a first nominal contact member, a second nominal contact member, a first arcing contact member and a second arcing contact member, an inner shield member and an outer shield member, wherein the inner shield member and the outer shield member are arranged coaxially about an axis, the method comprising:

moving the first arcing contact member and the second arcing contact member towards one another along the axis of the circuit breaker;

moving the first nominal contact member and the second nominal contact member towards one another along the axis, thereby moving the first nominal contact member relative to an inner shield member and to an outer shield member, thereby protruding the first nominal contact member axially from a volume between the inner shield member and the outer shield member towards the second nominal contact member;

contacting the first arcing contact member with the second arcing contact member for providing a current path between the first and second arcing contact members; and contacting the first nominal contact member with the second nominal contact member for creating a current path between the first and second nominal contact members, and wherein further the inner and outer shield members are held at the same electrical potential as the first nominal contact member.

22. The method according to any one of claim 20 or 21, wherein the gas-insulated type circuit breaker comprises:

a housing defining a gas volume for a dielectric insulation gas;

the first arcing contact member and the second arcing contact member, wherein the first arcing contact member and the second arcing contact member are movable relative to each other along the axis;

the first nominal contact member and the second nominal contact member, wherein the first nominal contact member and the second nominal contact member are movable relative to each other along the axis; and a first nominal contact shielding arrangement for electrically shielding the first nominal contact member, the first nominal contact shielding arrangement comprising the inner shield member and the outer shield member, the first nominal contact member is arranged co-axially between the inner shield member and the outer shield member and is movable relative to the inner shield member and to the outer shield member.

* * * * *